US007466228B2

(12) United States Patent
Wong

(10) Patent No.: US 7,466,228 B2
(45) **Date of Patent: *Dec. 16, 2008**

(54) CABLE CRASH BARRIER APPARATUS WITH NOVEL CABLE CONSTRUCTION AND METHOD OF PREVENTING INTRUSION

(75) Inventor: William Ah-Min Wong, Whittier, CA (US)

(73) Assignee: Disney Enterprises, Inc., Burbank, CA (US)

( * ) Notice: Subject to any disclaimer, the term of this patent is extended or adjusted under 35 U.S.C. 154(b) by 128 days.

This patent is subject to a terminal disclaimer.

(21) Appl. No.: 11/459,603

(22) Filed: Jul. 24, 2006

(65) Prior Publication Data

US 2006/0255937 A1 Nov. 16, 2006

Related U.S. Application Data

(62) Division of application No. 11/029,743, filed on Jan. 4, 2005.

(51) Int. Cl.

| | |
|---|---|
| ***G08B 13/00*** | (2006.01) |
| *G08B 13/18* | (2006.01) |
| *G08B 13/26* | (2006.01) |
| *E01F 13/00* | (2006.01) |

(52) U.S. Cl. ..... 340/541; 340/550; 340/552; 340/564; 404/6

(58) Field of Classification Search ..... 340/550, 340/541, 564, 552; 404/6
See application file for complete search history.

(56) References Cited

U.S. PATENT DOCUMENTS

| | | | | |
|---|---|---|---|---|
| 2,306,661 | A | | 12/1942 | Gengler |
| 3,763,482 | A | * | 10/1973 | Burney et al. ..... 340/564 |
| 3,833,897 | A | | 9/1974 | Bell et al. |
| 3,893,642 | A | | 7/1975 | Van Vlaenderen |
| 4,010,315 | A | | 3/1977 | Mildner |
| 4,144,530 | A | | 3/1979 | Redfern |
| 4,275,294 | A | | 6/1981 | Davidson |
| 4,304,320 | A | | 12/1981 | Hull |
| 4,450,434 | A | | 5/1984 | Nielsen et al. |
| 4,518,953 | A | | 5/1985 | Hunter et al. |
| 4,576,507 | A | | 3/1986 | Terio |
| 4,680,573 | A | | 7/1987 | Ciordinik et al. |
| 4,780,020 | A | | 10/1988 | Terio |
| 4,818,137 | A | | 4/1989 | Gorlov |
| 4,818,972 | A | | 4/1989 | Mainiero et al. |
| 4,829,287 | A | | 5/1989 | Kerr et al. |
| 4,920,331 | A | | 4/1990 | Ver Loren van Themaat et al. |
| 4,929,926 | A | | 5/1990 | Porat |
| 4,989,835 | A | | 2/1991 | Hirsh |
| 5,022,782 | A | | 6/1991 | Gertz et al. |
| 5,089,806 | A | | 2/1992 | Willis et al. |
| 5,268,672 | A | | 12/1993 | Kerr |

(Continued)

*Primary Examiner*—Daniel Wu
*Assistant Examiner*—Jack Wang
(74) *Attorney, Agent, or Firm*—Marsh Fischmann & Breyfogle LLP; Kent A. Lembke

(57) ABSTRACT

Cable crash barrier apparatus precludes unwanted ingress and egress and electronically monitors breaches. Substantial thickness of the cable provides mechanical integrity resistant to, for example, a 400 lb. vehicle traveling at speeds up to at least about 52 miles per hour, while flexibility protects a central conducting member effective for forming a low-voltage circuit, the cable being supported by a plurality of anchoring members and not detracting from overall aesthetic of the area being circumnavigated.

18 Claims, 6 Drawing Sheets

U.S. PATENT DOCUMENTS

| | | | | |
|---|---|---|---|---|
| 5,432,498 | A | 7/1995 | Zilbershtein et al. | |
| 5,453,916 | A | 9/1995 | Tennis et al. | |
| 5,624,203 | A | 4/1997 | Jackson et al. | |
| 5,823,705 | A | 10/1998 | Jackson et al. | |
| 5,852,402 | A | 12/1998 | Perry | |
| 5,987,204 | A | 11/1999 | Lee et al. | |
| 6,036,175 | A | 3/2000 | Harper | |
| 6,062,765 | A | 5/2000 | Dotson | |
| 6,289,634 | B1 * | 9/2001 | Allardyce et al. | 49/49 |
| 6,312,188 | B1 | 11/2001 | Ousterhout et al. | |
| 6,452,495 | B2 | 9/2002 | Choi | |
| 6,485,225 | B1 | 11/2002 | Baker | |
| 6,702,511 | B2 | 3/2004 | Russell | |
| 7,083,357 | B2 | 8/2006 | Lamore | |
| 7,140,802 | B2 | 11/2006 | Lamore | |
| 7,171,087 | B2 | 1/2007 | Takahashi | |
| 7,210,873 | B2 | 5/2007 | Gelfand | |
| 2003/0222254 | A1 * | 12/2003 | Bergendahl | 256/13.1 |
| 2005/0232693 | A1 * | 10/2005 | Sharp et al. | 404/6 |
| 2006/0083458 | A1 * | 4/2006 | Iffergan | 385/13 |
| 2008/0024297 | A1 * | 1/2008 | Maki et al. | 340/552 |
| 2008/0036597 | A1 * | 2/2008 | Harman | 340/552 |

* cited by examiner

CABLE CRASH BARRIER APPARATUS WITH NOVEL CABLE CONSTRUCTION AND METHOD OF PREVENTING INTRUSION

RELATED APPLICATION

This application is a divisional of U.S. application Ser. No. 11/029,743, filed Jan. 4, 2005, the content of which is incorporated by reference herein in its entirety.

BACKGROUND

1. Field

The present disclosure generally relates to novel cable constructions used in a barrier apparatus which cost effectively surround and monitor desired perimeter spaces while being disposed in an environment from which they are not readily distinguishable visually.

The present disclosure further relates to cable based barrier systems with additional security functions. More particularly, the present disclosure relates to crash-rated barrier mechanisms having anchor supports which are effective for housing low voltage currents to interdict and monitor vehicular intrusion over substantial perimeter distances through monitoring low voltage circuits, and providing real time monitoring of the breaches.

2. General Background

Fences have been known throughout history for blocking ingress and egress selectively. Among the best known examples of innovation in this technical field were related to the development of barbed members, which enhanced mechanical barrier functionality of generally taught wire systems with projection arms disposed radially about the wires, orthogonal to an axis running through the center of such wires. Such barbed wires were effective for controlling large groups of animals across vast spaces of territory required, often seasonally, to feed the animals with allowing them to escape from predetermined areas.

Heightened security needs over time have created the impetus for electrifying tubular wires, with and without the barbed extension members. An early example of such disclosures is found in U.S. Pat. No. 4,680,573; issued in July 1987 to Ciordinik, et al. While the basic rudiments of a conducting means, supporting arms and a mounting structure were shown by this patent, tampering with the security function was less challenging than the instant teachings, as the same could be circumvented by intended intruders, and this system also ostensively lacked the gross mechanical fortitude to prevent vehicles from penetrating through a protected perimeter.

Likewise, alternate mechanisms have been contemplated for intrusion detection and/or barrier breach that have yet to address the newly developed and pressing needs in this area. For example, U.S. Pat. No. 5,089,806 issued to Willis showed a chain which disclosed an audible alarm responsive to motion proximate to the chain-barrier. While the device of this patent had commercial implications within small fixed areas—such as retail grocery vending establishments, it is not practical to protect larger enclosures or address the needs in substantially larger perimeters.

Similarly, inflatable and deflatable barrier mechanisms have been disclosed to provide combined barrier and sensing mechanisms. U.S. Pat. No. 5,268,672 shows a correlation of hertz frequency vibrations with intruding activity and then sounds an alarm. Rudimentary signal processing methods and the readily available deflatable nature of the physical barrier with sensing cables distinguish the same from the instant teachings.

U.S. Pat. No. 5,453,916 issued to Tennis further defines the prior art landscape disclosing a modular highway safety lighting system. In contradiction to the instant teachings, this would not be able to prevent intrusion by a vehicle, let alone one traveling at high speeds or loaded with explosives.

Jackson's U.S. Pat. Nos. 5,624,203 and 5,823,705 disclose net barriers for railroad crossings showing the signaling mechanism as a break in the cable makes this system not sensitive enough for the needs addressed according to the instant teachings, as no monitoring system provided real-time signaling and data as to a specific location.

Russell's U.S. Pat. No. 6,702,511 utilizes air-bag technology to absorb energy and to supplement other barrier systems. Likewise, there is a monitoring system for breaches however, unlike the instant teachings it is based upon air pressure.

The two most salient references Baker's U.S. Pat. No. 6,485,225 and Ousterhout's U.S. Pat. No. 6,312,188 serve to further underscore the longstanding needs for the present disclosure. Both are readily distinguished from the instant teachings in that the former patent shows a complex magnetic system for creating a barrier on a throughway and the latter a complex netting system for entrapping a moving vehicle, which seems to have less robust capabilities than the present disclosure, based upon the disclosure. Those having a modicum of skill in the art will readily conclude that there exists a compelling need for novel, enhanced security systems including crash-rated barriers to stop moving vehicles, while alerting those monitoring such systems as to any serious incursion attempts.

According to the teachings of the present disclosure, these and other challenges, which remain as longstanding needs in the post Sep. 11, 2001 world, are embraced and overcome as heretofore contemplated yet ostensively unaddressed.

SUMMARY

A cable crash barrier apparatus is disclosed which precludes unwanted ingress and egress and electronically monitors breaches. Substantial thickness of a wire rope made of at least two strands of steel is used to form a cable which provides mechanical integrity resistant to, for example, a 4000 lb. vehicle traveling at speeds greater than 50 miles per hour, while flexibility protects a central conducting member effective for forming a low-voltage circuit, the cable being supported by a plurality of anchoring members and not detracting from overall aesthetic of the area being circumnavigated. The system and apparatus functions to work by blending in such that the resulting combination structure almost invisibly functions in complement with existing perimeter fencing and uses a specialized cable that allows for the security function while being robust enough to interdict any known commercial vehicles that could, be for example be loaded with explosives.

The evolution of crash testing, and use of the same with conventional cable barriers has enabled a cottage industry to develop for such undertakings. For example, the United States Air Force participated in industry-wide standard setting to facilitate development of different crash ratings, which are generally laboratory tested during manufacturing. The novel cable construction, including for this purpose the multi-layered steel rope assembly of the present disclosure has been evaluated under such standards and found to be sufficiently robust to achieve a 'crash-rating' by withstanding 59,000 pounds and between 4 and 5% elongation. These results, particularly the unexpected robustness of the instant disclosure, allowed further refinements to be made with respect to protection of the inner conductive member, as is discussed further and claimed below.

Given that those engaged in contemporary versions of the sabotage of public and large-scale entertainment facilities (for example theme parks), and/or urban terrorism, have resorted to vehicular transport means for explosives, the need for seriously enhanced security measures has become urgent. For example, even in less developed regions, the access to automobiles as transport mechanisms continues to be exploited for nefarious and often lethal purposes. Urban and suburban centers in the United States have become particularly susceptible to such incursions, making camouflage for such barriers yet another level of protection.

Having a global presence and a need for the same degree of security at locations as diverse as Tokyo, Paris, Hong Kong and Orlando, Fla. further underscores the necessity of providing a cost-effective an unobtrusive means to supplement existing perimeter fencing and security systems, particularly in places with high customer traffic. To meet these needs there is disclosed a novel enhanced cable construction made up of a braided rope assembly of a least two strands, defining an outer layer and a lumen effective for housing a discrete central core member, the braided rope assembly having a coatable outer surface and an inner zone having adequate space to protect said discrete central core member from loading when the braided rope assembly is stressed but not severed. It may be steel, kevlar or those materials that artisans would readily substitute to be flexible but strong enough to withstand moving vehicles.

A crash barrier apparatus for precluding unwanted vehicular access comprises a plurality of anchored bollards, extending between fixed deadman structures, a bi-layered coaxial rope assembly including a flexible outer cable effective to restrain a traveling vehicle having a discrete central core member, the central core member being a conductor forming a low-voltage circuit; and an alarm panel responsive to interruptions in the circuit whereby a signal is generated providing real time information as to a zone of breach and wherein the crash barrier apparatus is effective for being disposed in an environment from which it is not readily distinguishable visually.

A specialized cable assembly is made up of a plurality of strands of wire rope, comprised of conventional steel, wrapped with customized colorized high density polyvinyl ethylene effective for stretching to withstand substantial tension, while protecting an inner core of polyethylene sheathed conducting fiber such that a low voltage circuit is maintained until either an interruption is detected and/or an actual incursion is attempted, which incursion is detected by an associated sensor receiver unit.

A method for preventing intrusion comprising the steps of providing a crash-rated barrier system to encircle a perimeter with an outer cable housing an inner electrical circuit which is monitored by an electronic monitoring system, includes the steps of monitoring the circuit for interruptions in current, mapping the locus of any interruptions in current over the perimeter of a designated area, alerting a sensor receiver unit for transmitting data as to the mapped loci of interruptions, and repeating any of the preceding steps.

BRIEF DESCRIPTION OF THE DRAWINGS

The above-mentioned features and objects of the present disclosure will become more apparent with reference to the following description taken in conjunction with the accompanying drawings wherein like reference numerals denote like elements and in which.

DETAILED DESCRIPTION

The present inventor has discovered a crash-tested barrier system with a monitoring system can effectively interdict unwanted vehicular ingress and egress, without any compromise of the aesthetics required within the context of an entertainment park complex. By using a novel approach to design of a cable structure, it is possible to combine flexibility with required conductivity such that a connected sensor/receiver mechanism alerts users as to any interruption in the involved low voltage circuit and pinpoints the location.

Crash testing reveals that in one embodiment, the cable crash barrier apparatus in accordance with the present disclosure could prevent a 4000 lb vehicle traveling at speeds, in excess of at least about, 50 miles per hour from passing through a desired perimeter being surrounded. Likewise, field testing at the Disneyland® Resort in Anaheim, Calif. indicated a positive functional result for the monitoring function imparted by the central conducting member, as schematically illustrated below, and described throughout the instant teachings.

Figure 1:
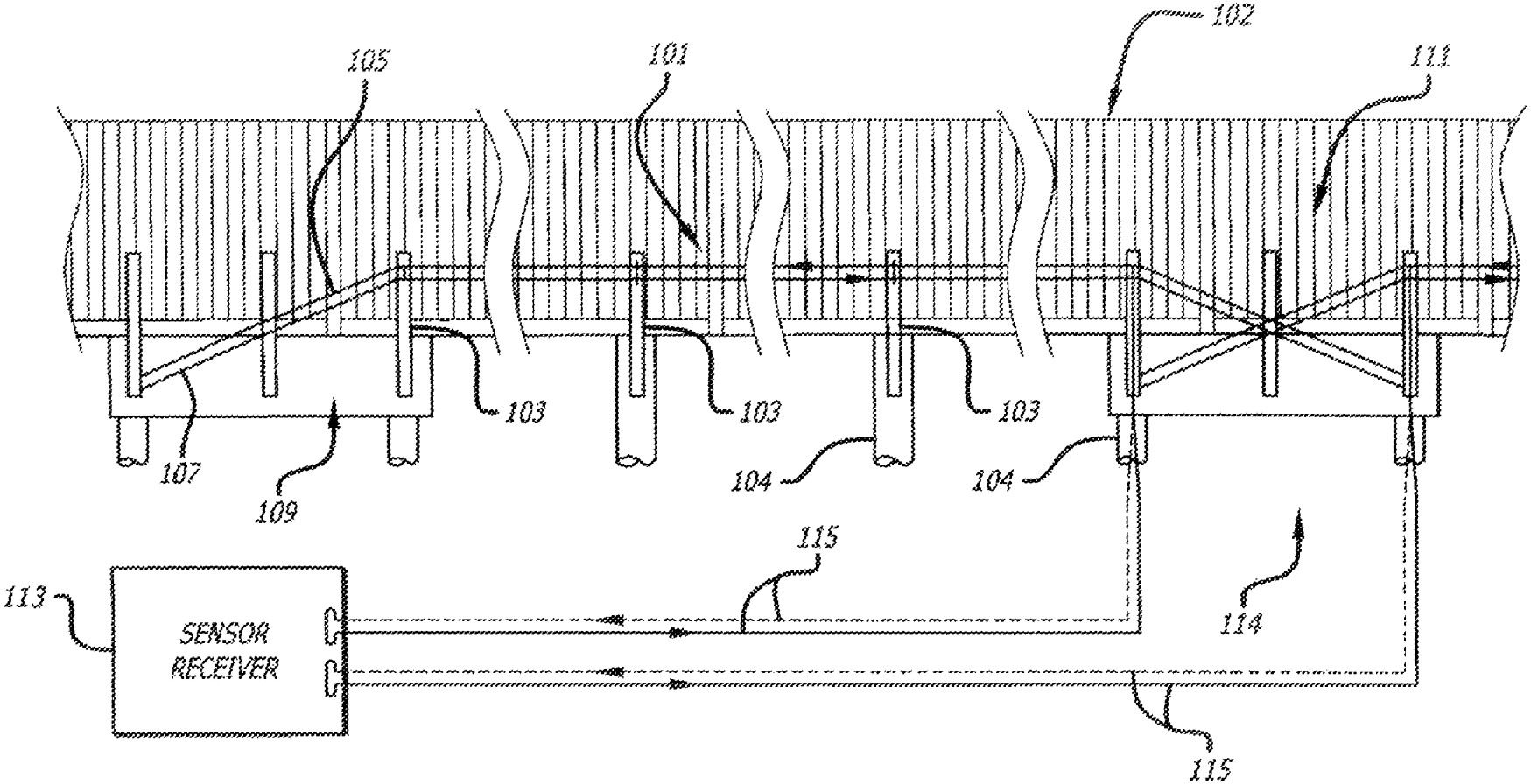
FIG. 1 is a schematized partial plan view of one embodiment in accordance with the teachings of the present disclosure, showing the same as used in conjunction with conventional fencing means.

Turning now to FIG. 1, an emplaced crash barrier apparatus, shown generally at 101 is shown as installed in conjunction with a conventional perimeter fence 102. Bollards 103 are supported by interchangeable materials which function as anchors 104 (in this case, concrete bore piles, materials available from SIKA Corp., Santa Fe Springs, Calif.) to prevent unwanted movement in bollards 103 which work by suspending cable structures 105, 107 between fixed deadman structures 109,111. It is noted that there are at least two kinds of these structures shown, intermediate and terminal deadmen, having the same function, which is to provide mechanical integrity and stability. The present inventor has discovered that as the crash rating is maintained with use of at least two intermediate bollards 103, having concrete bore anchoring mechanisms 104.

Sensor/Receiver mechanism 113, is in electrical communication with, and is actuated by interruptions in the low voltage circuit formed by conductive element 114, (which is shown only schematically in this view, see 114 in FIG. 8 for a detailed view) along electrical line 115.

Signals pin-point the location of any attempted incursions along electrical line 115, and allow users to have real time access to such data as such events occur. Likewise, conventional data storage and retrieval means function in complement with the instant teachings to provide for records of the same, as would be known to those of conventional skill in the security monitoring fields.

Figure 2:
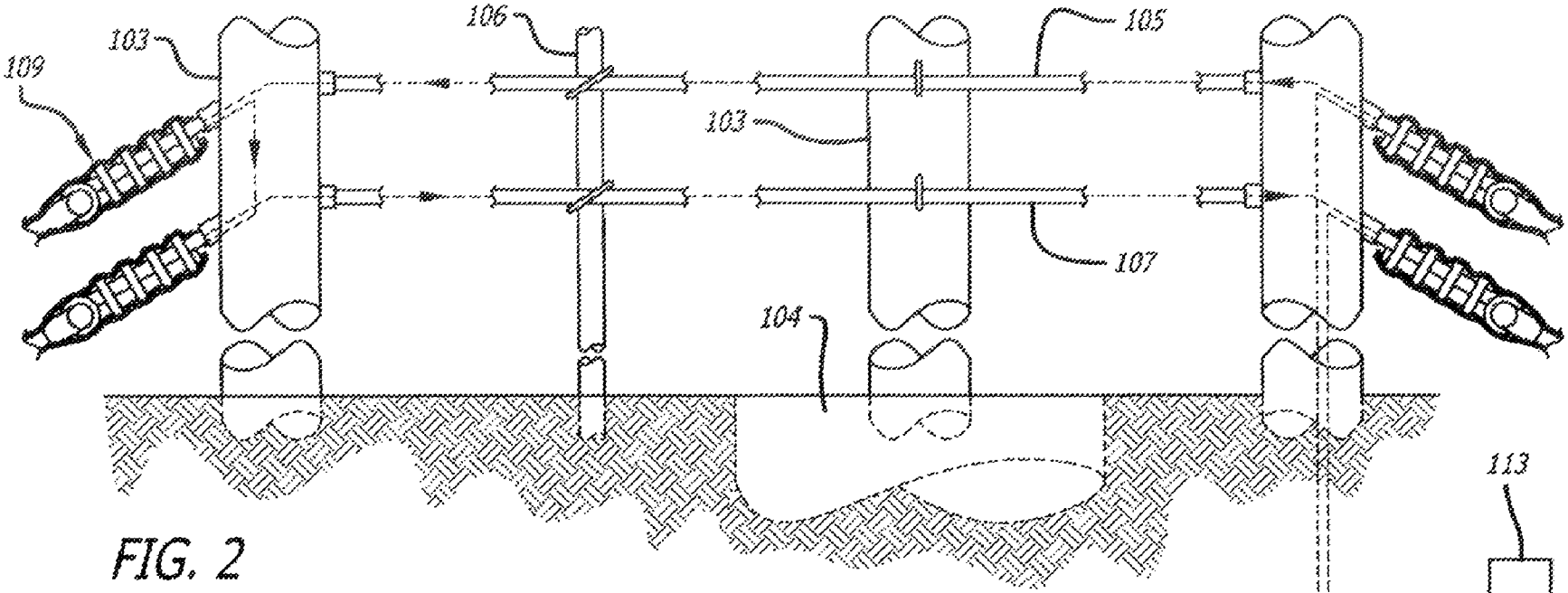
FIG. 2 is another view of one embodiments in accordance with the present disclosure showing attachment of outer cables to fence posts and bollards and a terminal section according to teachings of the present disclosure.

Turning now to FIG. 2, cable structures 105,107 are suspended between at least two of bollards 103 and conventional fence posts 106 each of which is attached to a respective anchor 104. Likewise, reinforced sheath 109 protects each cable 105,107 from being exposed to either forces of nature, or the ready view of subversive elements for whom ready view of, or access to the present disclosure is denied (or their tools for disabling, violating or otherwise committing predicate acts to or the penetrating of barriers) at the anchor point, this further prevents interruption in the mechanical integrity of crash barrier apparatus 101.

In the figures presented, which are offered for consideration only for illustrative purposes and not as limiting examples, it is noted that the cable crash barrier can be located on either side of a conventional fence, adjacent to the same either within or outside of the perimeter being monitored. It should be noted that embodiments of the instant teachings are generally covered with some manner of coating/coloration/treatment/ pigmentation that allows them to be blended into their local environment—or 'camouflaged' such that they are not readily distinguishable visually from the same. For example, referring back to FIG. 1, the conventional perimeter fencing structure 102 is covered with a forest green hued paint, and the conventional fence posts associated therewith likewise colored in a fashion to appear as close to the natural coloration of a 'hedge-row' of perimeter bordering structure of natural vegetation (eg. native scrub brush and pine-related species, principally). According to this example, the embodiment 101 of the present disclosure is likewise imbued with a forest green tone, including as many elements as needed to create the visual impression to an observer that the cable crash barrier system and the existing fence are one system.

Likewise, the cable crash barrier apparatus can function as a stand alone structure or in complement with such other and further assemblies and structures as would become clear to artisans, reading the descriptions below.

Figure 3:
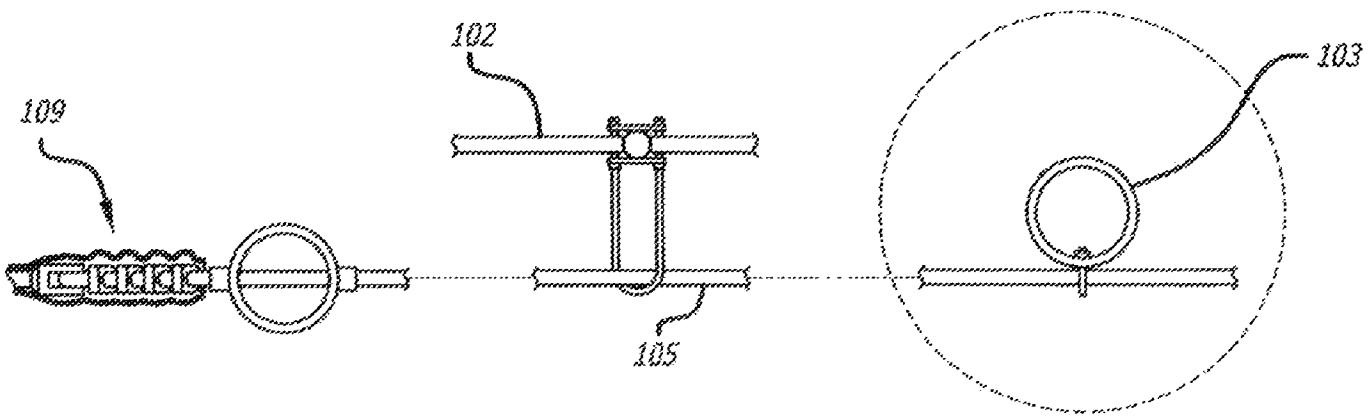
FIG. 3 is a top view of one embodiment of the present disclosure as shown in FIG. 2, illustrating the extension of the instant cables from a terminal section through a fence post and a bollard according to teachings of the present disclosure.

FIG. 3 shows a top view of FIG. 2, with cable structure 105 and reinforced sheath 109 and bollard 103, with exemplary concrete anchor 104 being shown in dashed lines. Materials effective for use as cable structure 105 include six strand wire rope, made of conventional steel, which may be wrapped with customized colorized high density polyvinyl ethylene [HDPE] coating (Bridon American, Wilkes-Barre, Pa.) effective for stretching to withstand substantial tension, while protecting an inner core of polyethylene sheathed conducting fiber. As assembled in combination with anchored bollards 103, cable structure 105 has been crash tested and found to be functionally appropriate at either a diameter ranging from at least about ⅝" to ¾", although different crash rating would allow these ranges to be modified, and the rope assembly itself may either be galvanized or wrapped with HDPE coating, or equivalents according to the teachings of the present disclosure.

Figure 4:
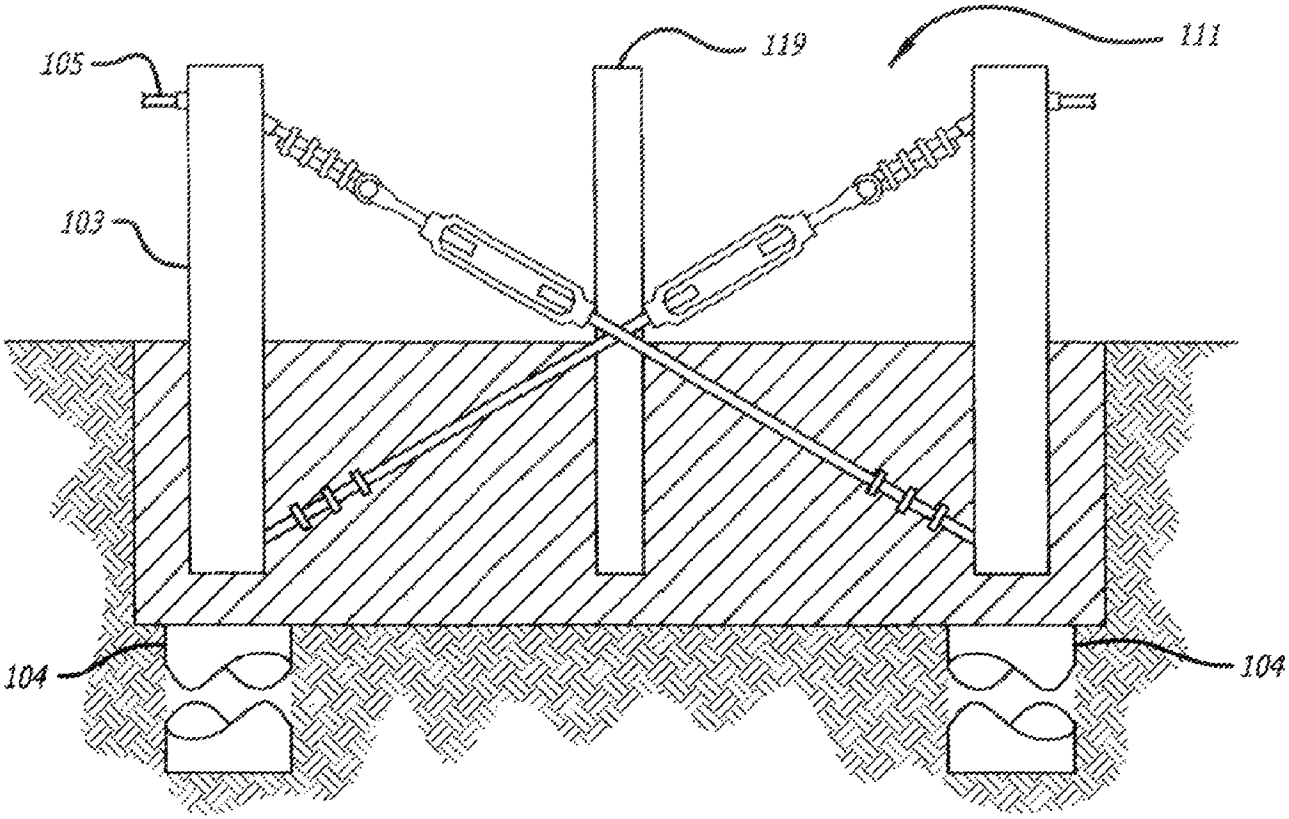
FIG. 4 is a front view of an intermediate terminal section according to one embodiment, showing details of anchoring.

Turning to FIG. 4, intermediate fixed deadman structure, shown generally at 111 is fixed by providing each respective bollard 103, with anchor 104. It is noted that provision of a supplemental crash rated fixed bollard 119, protects supplemental anchor rods, as would be clear to those skilled in the art of construction.

As discussed, concrete has been tested and found to be appropriate for use within the context of the instant system; however, artisans can substitute related building and construction materials. Cable structure is shown and has been tested at a breaking strength of between at least about 59 kips and 64 kips, having an ultimate strain of between at least about 0.04 and 0.05. When fixed according to the instant teachings, the crash barrier can stop for example a 4000 lb vehicle moving at 52 miles per hour.

Figure 5:
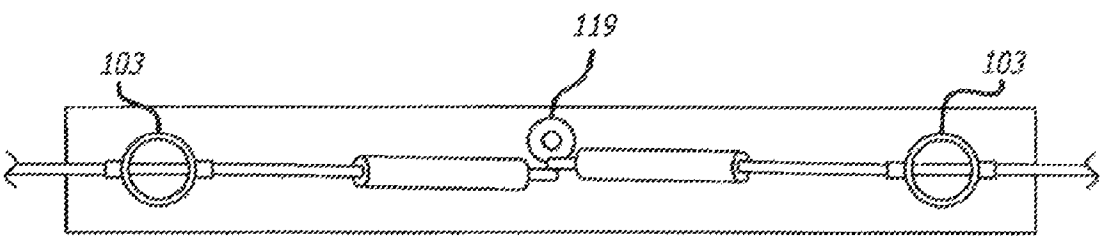
FIG. 5 is a top view of the structure shown in FIG. 4 in further detail, according to one embodiment.

FIG. 5 likewise shows a top view of bollard 103, with anchor 104. Cable structure 105 is shown from the top as also, showing how the underlying mechanical integrity is maintained without complex and fault-prone mechanisms, only supplemental fixed bollard 119 is added to the existing structure at this intermediate terminal point.

Unlike known systems that were researched in the process of developing the cable crash barrier apparatus, by using, for example an anchor post and two cables at a ¾ inch diameter, the crash testing strength is effective for precluding unwanted vehicular ingress. By the same token, the present disclosure could further be used to preclude egress of vehicles with the same ability to preclude unfettered, and/or unmonitored breach.

Figure 6:
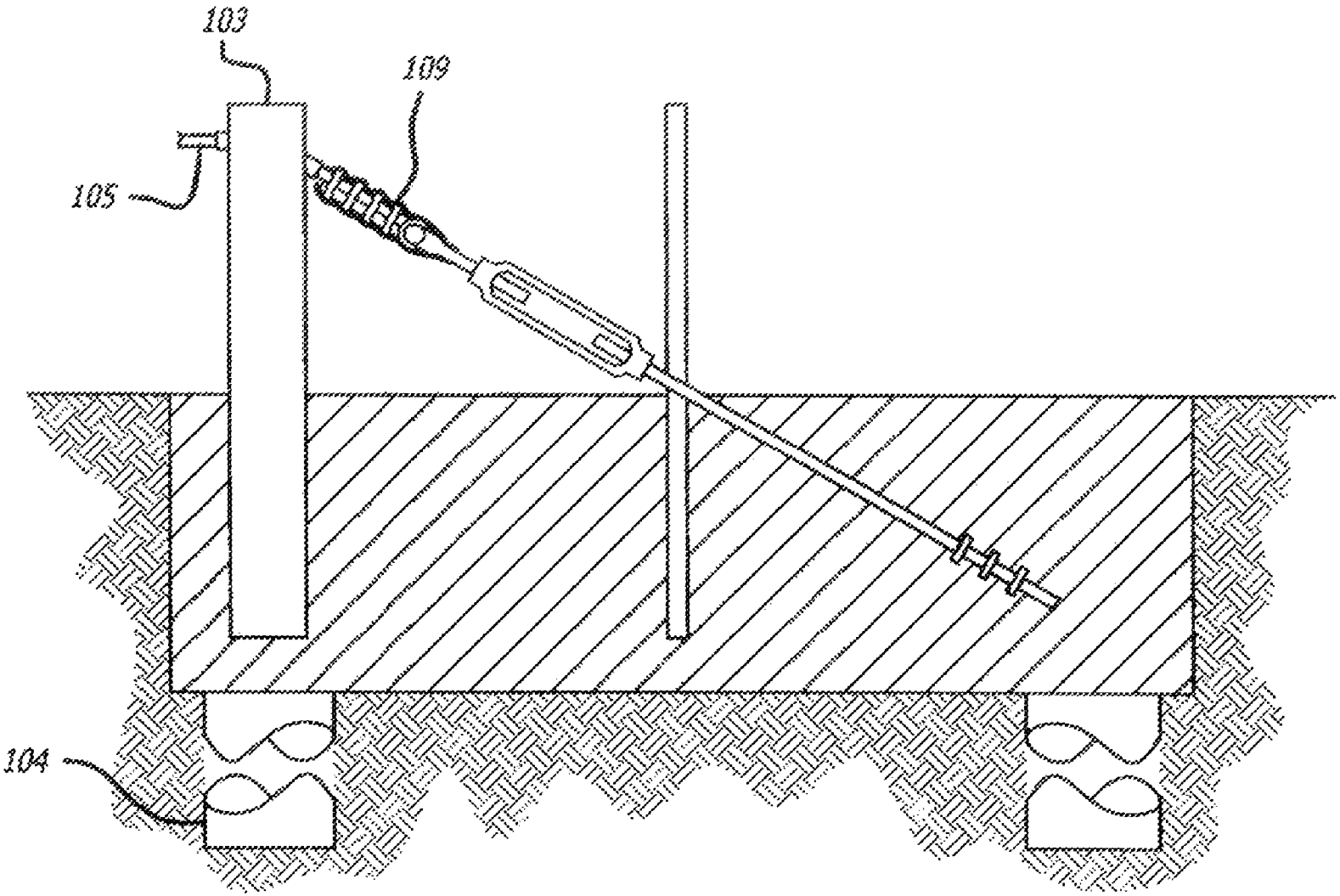
FIG. 6 shows anchoring mechanisms at an end terminal end according to one embodiment.

FIG. 6 provides a view of end terminal deadman structure 109, which works with the novel cable structure 105, and fixed bollard 103 anchored by the above described concrete structure 104 to allow adequate flexure, yet be unobtrusively blended into the background. It is noted that artisans readily can substitute desired terminal sections based upon other perimeter—related constraints.

According to a crash tested and electrical safety rated embodiment of the present disclosure (Disneyland® Resort, Anaheim, Calif.) customized HDPE coating, used in conjunction with a six-strand braided wire rope, having a dark or forest green-hue matching the conventional fence 102 (shown in FIG. 1) was found to render the present disclosure 'camouflaged' or at the very least less visible as a security system, thus enhancing its functionality. Without ready access to the important functional elements of such a system, it becomes increasingly difficult, even with advanced planning, to disarm or disable the same—let alone effectively cover an incursion through the present inventive system.

Figure 7:
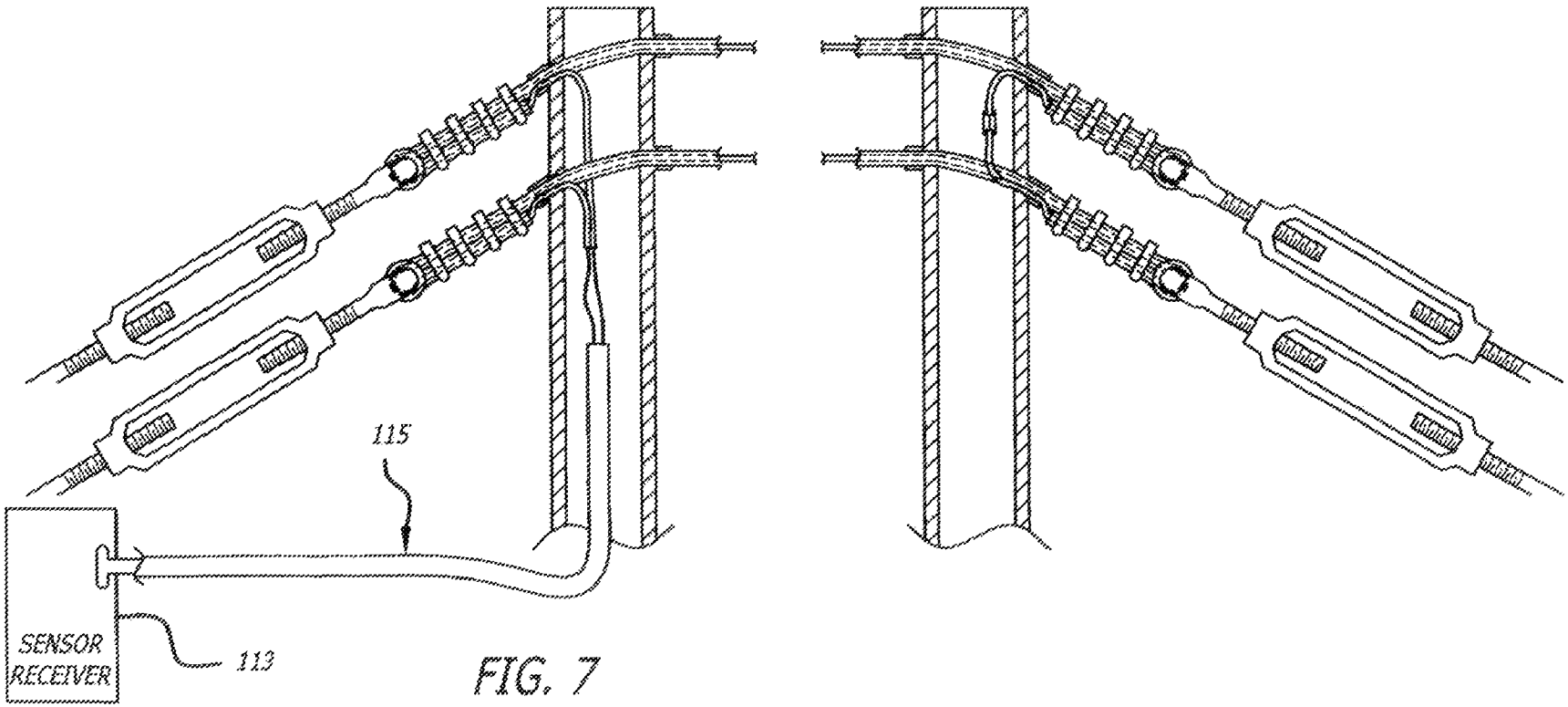
FIG. 7 is a partial cut-away view of further detail of the underlying electronics according to one embodiment.

FIG. 7 schematically adds further detail to the workings of disclosures according to embodiments the present invention, showing a single loop diagram which further defines the workings of embodiments of the present disclosure. It is further noted that the instant disclosure effectively functions in complement with an existing fencing structure, or exists on a stand alone basis. Sensor receiver 113 is in electrical communication with the entire crash barrier apparatus (101, see FIG. 1) via electrical line 115 to monitor breaches in the same as noted by circuit breakage.

Sensor/receiver 113 thus is effective for gathering input by way of a conventional mechanism which relates interruptions in current to a time of the break in the low voltage circuit. Likewise, using the situs of interrupted current along electrical line 115 as a marker, a mapping step further includes gathering input by way of relating interruptions in current to a physical location of the break in the low voltage circuit, and the mapping step may include transmitting data from the sensor receiver 113 to a central processing unit. The present disclosure further contemplates transmitting data to a user regarding a breach of the crash-rated barrier system, and can do so in real time.

Figure 8:
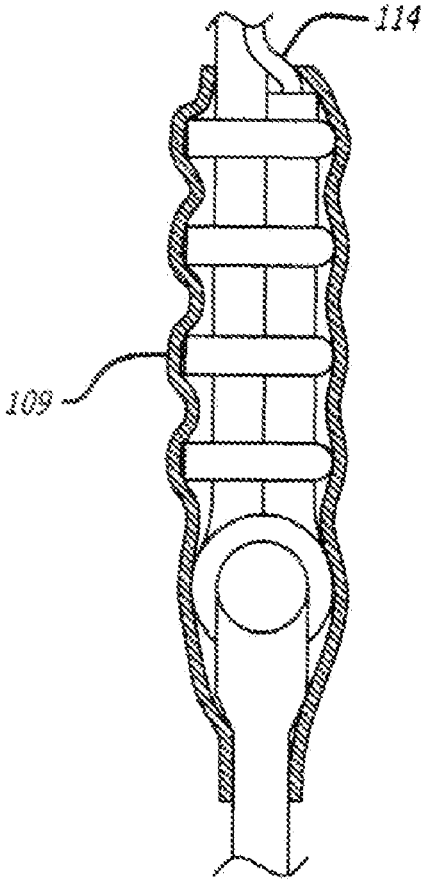
FIG. 8 is a cross-sectional view of aspects of the instant teachings shown in FIG. 7.

Turning to FIG. 8, cable structure 105 houses conductor 114, and in this example conductor 114 is conformed with the following parameters; Anixter No.: 5MF-1601-EPDMB, strand 26×30, 16 AWG tinned copper, the insulation is EPDM, having a thickness of 0.045 inches, the temperature is 125 degree C. flex, 150 degree C. non-flex, and the voltage is 600 volts, there is also a nominal O.D. of at least about 0.155 inches.

FIG. 8 likewise shows internal details of either cable structure 105, 107 including the placement of conductor 114 and supplemental outer sheath 109 which further precludes intervenors from accessing or interfering with the operations of the present disclosure. As with the camouflaged nature of the entire system, supplemental outer sheath 109 blends in with the environment and/or the conventional fencing structure to provide for lower likelihoods of attack by those whose intention it is to penetrate or infiltrate the system.

Figure 9:
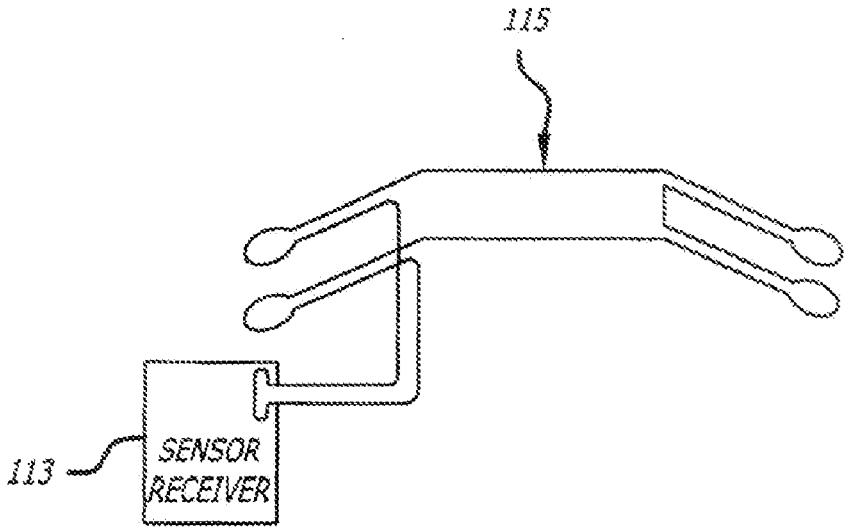
FIG. 9 is a schematic diagram of a circuit which works according to an embodiment of the teachings of the present disclosure.

Turning to FIG. 9, which likewise shows a schematic diagram of the system which functions, in the example, according to the instant embodiment, as a low voltage circuit until sensor receiver 113, detects breaches of the system by breaks in the electrical connectivity of electrical line 115. Artisans will readily understand how the positions of respective breaches of electrical 115 manifest themselves in terms of their positional/spatial relationship within the system in accordance with the present disclosure.

While the apparatus and method have been described in terms of what are presently considered to be the most practical and preferred embodiments, it is to be understood that the disclosure need not be limited to the disclosed embodiments. It is intended to cover various modifications and similar arrangements included within the spirit and scope of the claims, the scope of which should be accorded the broadest interpretation so as to encompass all such modifications and similar structures. The present disclosure includes any and all embodiments of the following claims.

The invention claimed is:

1. A method for preventing intrusion comprising the steps of:

providing a crash-rated barrier system along at least a portion of a perimeter of a designated area with an outer cable housing an inner electrical circuit which is monitored by an electronic monitoring system;

monitoring the circuit for interruptions in current;

mapping the locus of any interruptions in current over the portion of the perimeter of the designated area;

alerting a sensor receiver unit for transmitting data as to the mapped loci of interruptions; and repeating any of the preceding steps.

2. The method of claim 1, wherein the outer cable comprises a structurally reinforced outer cable made up of a plurality of wire ropes of steel ranging from at least about ¾ of an inch to ⅞ of an inch in diameter.

3. The method of claim 2, wherein the inner electrical circuit comprises a central conducting member forming a low voltage circuit being a polyethylene coated wire, in electrical communication with the sensor receiver system.

4. The method of claim 3, the monitoring step further comprising:

gathering input by way of a sensor receiver mechanism which relates interruptions in current to a time of the break in the low voltage circuit.

5. The method of claim 4, the mapping step further comprising:

gathering input by way of a sensor receiver mechanism which relates interruptions in current to a physical location of the break in the low voltage circuit.

6. The method of claim 5, the mapping step further comprising:

transmitting data from a sensor receiver mechanism to a central processing unit.

7. The method of claim 6, the alerting step further comprising:

transmitting data to a user regarding a breach of the crash-rated barrier system.

8. The method of claim 7, the alerting step further comprising transmitting the data in real time.

9. The method of claim 8, the crash barrier system being effectively colorized for being disposed in an environment from which it is not readily distinguishable visually, by matching select aspects of any existing system adjacent to which the system is installed and blending in with local flora.

10. The method of claim 1, wherein the crash-rated barrier system has been crash-rated to withstand a force of a moving vehicle and has between about 4 and 5 percent elongation at breakage.

11. The method of claim 1, wherein the outer cable comprises a steel braid having an inner zone for receiving the inner electrical circuit, the outer cable and inner zone configured to protect the inner electrical circuit from excess loading when the steel braid is stressed causing it to elongate but not be severed.

12. A method of limiting and detecting vehicular access, comprising:

providing a crash barrier apparatus comprising a rope assembly suspended between bollards, wherein the rope assembly includes a flexible outer sheath and a conductive element positioned within the flexible outer sheath and further wherein the flexible outer sheath is configured to have a strength to restrain a traveling vehicle;

passing current through a circuit including the conductive element; and monitoring the circuit for an interruption in the current.

13. The method of claim 12, wherein the flexible outer sheath comprises a braid of wire rope including an inner zone for receiving the conductive element and sized to protect the conductive element to prevent the interruption in the current during elongation of the braid of the outer sheath of less than about 4 percent.

14. The method of claim 12, wherein the vehicle weighs about 4000 pounds and is traveling less than about 50 miles per hour.

15. The method of claim 12, wherein the strength of the flexible outer sheath is a breaking strength of at least about 59 kips and the flexible outer sheath has an ultimate strain of at least about 0.04.

16. The method of claim 12, further when the monitoring identifies the interruption in the current, relating the interruption to a physical location of a break in the conductive element.

17. The method of claim 16, further comprising transmitting data to central processing unit including the physical location of the break.

18. The method of claim 12, wherein the interruption of the current is effected by a breakage of both the conductive element and the flexible outer sheath.

* * * * *